United States Patent [19]

Gillum, Sr.

[11] Patent Number: 4,802,683

[45] Date of Patent: Feb. 7, 1989

[54] WHEELCHAIR WIDTH REDUCING ATTACHMENT

[76] Inventor: J. T. Gillum, Sr., 4418 NW. 32nd Ave., Gainesville, Fla. 32606

[21] Appl. No.: 82,905

[22] Filed: Aug. 10, 1987

Related U.S. Application Data

[63] Continuation-in-part of Ser. No. 931,332, Nov. 13, 1986, abandoned.

[51] Int. Cl.[4] ..... A47C 4/00

[52] U.S. Cl. ..... 280/304.1; 280/250.1; 297/42; 297/45; 297/DIG. 4

[58] Field of Search ..... 280/289 WC, 241 WC; 248/436; 297/338, 339, 348, 347, 42, 43, 45, DIG. 4

[56] References Cited

U.S. PATENT DOCUMENTS

| | | | |
|---|---|---|---|
| 711,221 | 10/1902 | Manning et al. | 297/68 |
| 768,311 | 8/1904 | Roberts | 297/356 |
| 2,669,289 | 2/1954 | Usher et al. | 280/42 X |
| 2,824,597 | 2/1958 | Lerman | 297/45 X |
| 3,409,924 | 11/1968 | Oja et al. | 297/45 |
| 3,823,979 | 7/1974 | Davis, Sr. | 297/330 |
| 3,968,991 | 7/1976 | Maclaren | 248/436 X |
| 4,082,348 | 4/1978 | Haury | 297/45 |
| 4,264,085 | 4/1981 | Volin | 280/289 WC |
| 4,375,295 | 3/1983 | Volin | 280/289 WC |
| 4,477,117 | 12/1984 | Higgs | 297/45 |
| 4,500,109 | 2/1985 | Volin | 280/650 |
| 4,553,770 | 11/1985 | Lyman | 297/DIG. 4 |

FOREIGN PATENT DOCUMENTS

| | | | |
|---|---|---|---|
| 2258818 | 8/1975 | France | 297/45 |
| 749119 | 5/1956 | United Kingdom | 297/45 |

*Primary Examiner*—James T. McCall
*Attorney, Agent, or Firm*—Arthur G. Yeager

[57] ABSTRACT

An attachment is provided for a typical folding wheelchair. The attachment includes a handle or lever which can be pushed downward by the occupant of a wheelchair to raise the seat thereby causing the wheelchair to partially fold and reducing its overall width. A pawl and toothed bracket are provided to selectively hold the chair in predetermined conditions of reduced width. A lifting lever may be positioned either for operation by an occupant or by an attendant and the lever mechanism may be rotated away from the occupant of the chair to avoid restricting his movement. Optional power operated means are also shown which can be used in tandem with or as a replacement for the manually operated means. The power operated means include a battery operated motor and a cable which is pulled or allowed to retract by a crank lever rotated by the motor. Another form of power operated means uses the electric motor to wind a cable on a drum thereby lifting the chair seat to which the cable is connected.

17 Claims, 5 Drawing Sheets

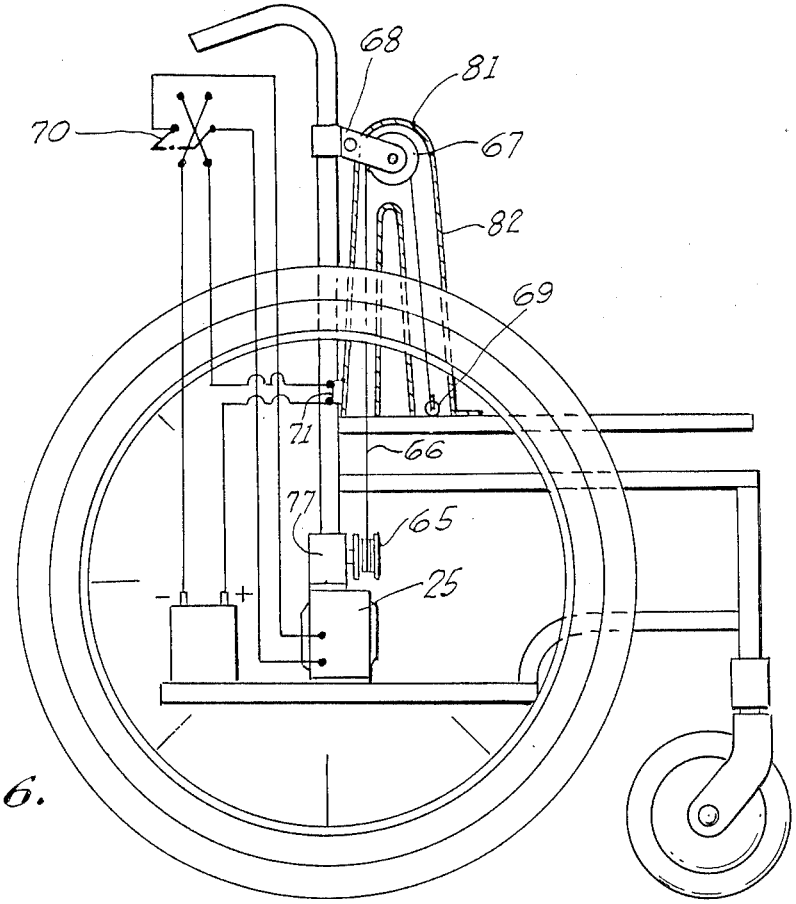
Figure 6.
Figure 7.
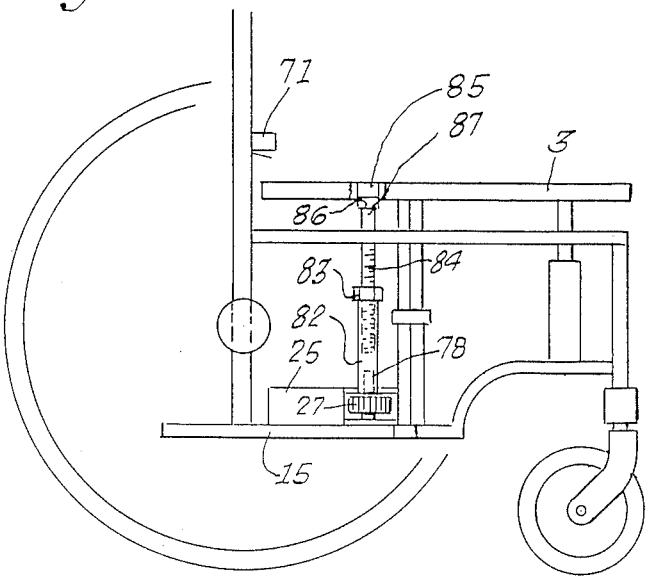
Figure 8.
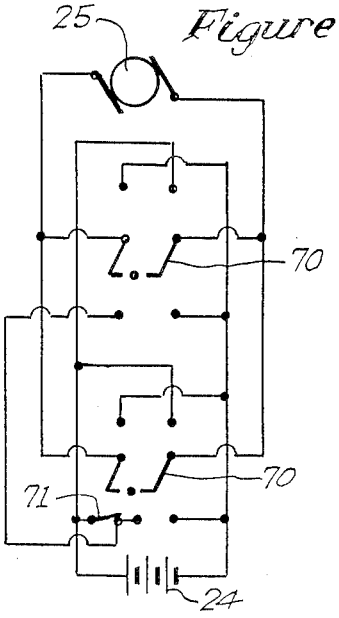

WHEELCHAIR WIDTH REDUCING ATTACHMENT

This application is a continuation-in-part of application Ser. No. 931,332, filed on Nov. 13, 1986, now abandoned.

BACKGROUND OF THE INVENTION

Many persons of reduced physical capability are confined to wheelchairs and more and more areas are being made accessible to wheelchairs. The wheelchair itself has been reduced to a fairly standardized design and most innovations in this area are in the form of complementary attachments to such a wheelchair. A commonly encountered difficulty with the standard wheelchair is its inability to traverse narrow or confined passages. Although several attempts have been made to provide attachments which will selectively reduce the width of a wheelchair, the problem has not been economically and reliably met in the prior art. Previous attachments for this purpose suffer from an inability to be operated while the chair is occupied or by persons with reduced physical capacity.

The typical wheelchair consists of a pair of rigid side frames joined together by pivoted cross braces and having a flexible back and seat so that the chair an be collapsed into a fairly compact package for storage or transport when not in use. Some of the prior art has focused on holding the chair in a partially collapsed position to reduce its width with the adjustments to the chair width having to be made with the chair unoccupied. Other attempts to avail the user of a variable width wheelchair require operations from portions of the chair difficult for the occupant to reach, or require excessive force to operate while a user occupies the chair, or require a counterproductive opposed force relationship between the user and the operating attachment. This opposed force relationship may be seen in instances in which the user pulls up on a lever to lift the seat and partially collapse the chair thereby forcing himself downward on the very seat which he is attempting to lift upwards.

SUMMARY OF THE INVENTION

This invention embodies apparatus which may be part of a standard wheelchair or added thereto as an attachment. Although the wheelchair itself may be modified to make it easier or more convenient to apply the invention, such modifications are not required and are not shown. The wheelchair shown and described herein is for purposes of illustration only and should not be construed as limiting the invention.

The apparatus of this invention provides a practical solution to the problems and disadvantages encountered in previous attempts to provide wheelchair width adjustment.

One object of the present invention is to provide a means for reducing the width of a wheelchair operable with a minimum of applied force while the chair is occupied.

Another object of this invention is to provide an attachment so that either the occupant or an attendant may reduce the wheel-to-wheel width of a wheelchair while it is occupied.

Another object of this invention is to provide an attachment for reducing the wheel-to-wheel width of a wheelchair which has an operating position and an inactive, out of the way, position.

Another object of this invention is to provide an attachment which will reduce the wheel-to-wheel width of a wheelchair while occupied and selectively allow that reduced width to be maintained without further application of force until the full width is once again desired or return to full width as soon as application of force is discontinued.

Another object of the present invention is to provide an attachment to reduce the width of a wheelchair which may be operated from either the left or the right hand side of the wheelchair.

Another object of the present invention is to provide an attachment to adjust the width of a wheelchair which is simple in construction and reliable in operation. Still another object of the invention is to provide an attachment to adjust the width of a wheelchair which may selectively be locked in a predetermined position of adjustment.

Still another object is to provide such an attachment which may optionally be power operated so that it may be used by a person of reduced physical capacity.

Another object of the invention is to provide an attachment to adjust the width of a wheelchair which is inexpensive in nature.

Other objects and advantages will be apparent after review of the drawings and the following detailed description.

BRIEF DESCRIPTION OF THE DRAWINGS

FIG. 6 is a schematic partial representation of another form of power operated option.

FIG. 7 is a schematic partial representation of still another form of power operated option.

FIG. 8 is a schematic representative of the basic electrical circuitry of the apparatus shown in FIG. 7.

DETAILED DESCRIPTION

Figure 1:
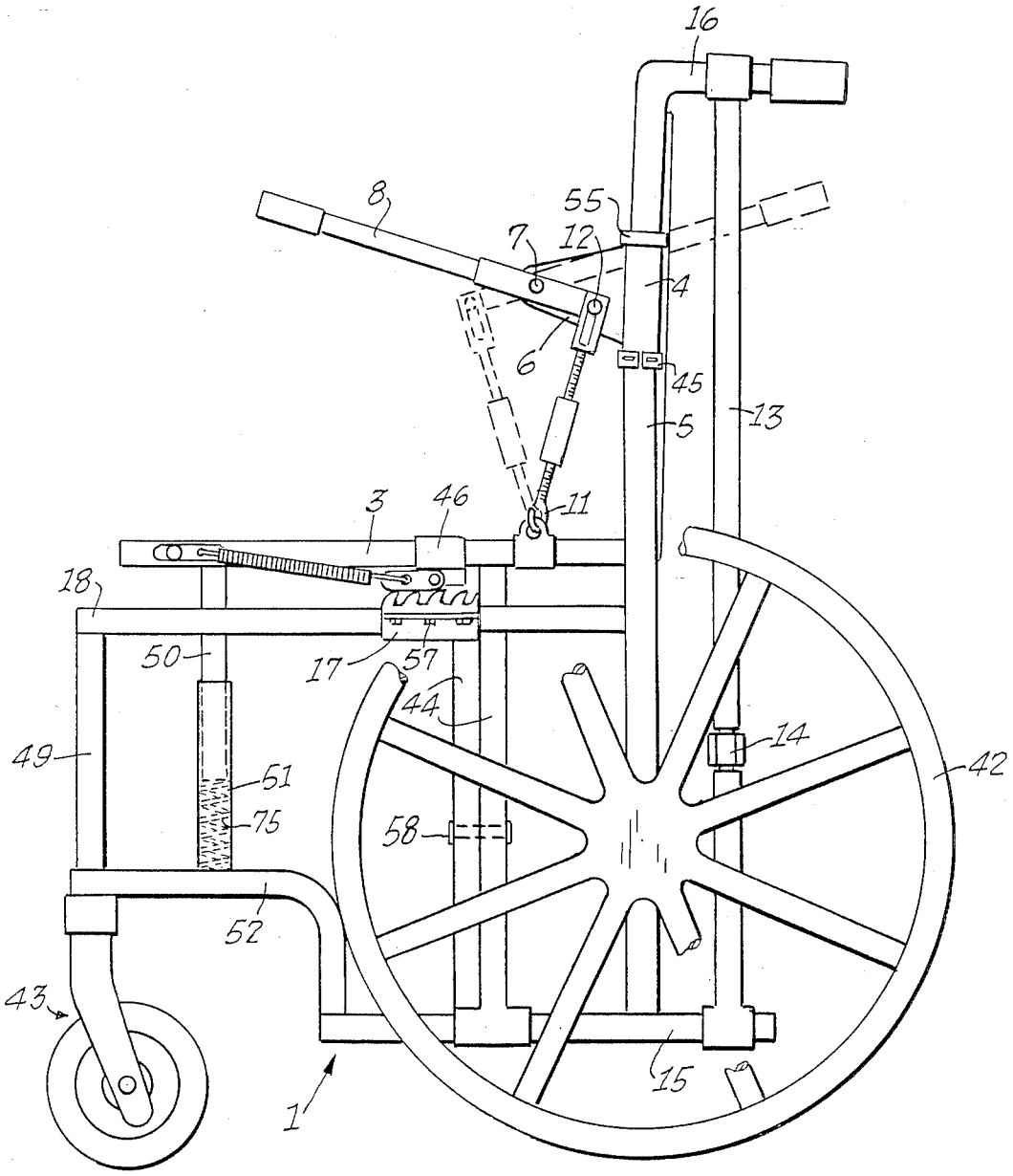
FIG. 1 is a side view of a wheelchair equipped with one embodiment of the present invention.

Examining the drawings in detail, FIG. 1 illustrates a conventional wheelchair of the type for which this invention is intended. The invention herein described may be provided as a standard operating feature on a wheelchair or as a device which may be added to an existing wheelchair. The wheelchair herein shown and described is merely an example of a typical collapsible wheelchair to which the invention is intended to be applied. Generally, such a wheelchair is constructed so that it will collapse from side to side when the seat is raised with respect to the main body of the chair.

Such a wheelchair has a pair of rigid side frames joined by pivoted cross members and a seat back made of flexible material. In FIG. 1 this conventional wheelchair 1 is shown as having main vertical frame members 5, on which the rear wheels 42 are rotatably mounted, and upper and lower main horizontal frame members 18 and 15 respectively rigidly secured to the main vertical frame members 5. Horizontal frame extension members 52 are rigidly secured to lower main horizontal frame members 15 and are offset to provide space for front wheel assemblies 43. Main vertical frame members 5, have integral handle portions 16 which are disposed at an angle from the main vertical frame members 5. Cross members 44 have their upper ends secured to horizontal seat support members 3 and their lower ends secured to lower main horizontal frame members 15. At the point where they cross, cross members 44 are connected for pivotal movement by a bolt, rivet or other suitable fastening means 58. The width reducing attachment of this invention includes means operable by the occupant or by an attendant and includes a reduction linkage which is operatively mounted between the main vertical frame members 5 and the corresponding horizontal seat support members 3. In FIG. 1 the width reduction linkage is shown in two of the possible positions, the full line drawing shows the width reduction linkage in the occupant operated position, the dot-dash lines indicate the attendant operated position. Lower main horizontal frame member 15 is rigidly connected to upper main horizontal frame member 18 through main vertical frame member 5 at the rear and through horizontal frame extension 52 and a front vertical frame member 49. Tubular telescoping frame members 51 and 50 are rigidly secured to horizontal frame extension 52 and seat support members 3 respectively to help stabilize seat support members 3 and cross members 44. Usually a compression spring 75 is provided inside tubular frame member 51 to provide resilient support of the seat. When the chair is fully open, the occupant is supported resiliently on the seat with seat support members 3 lying slightly above upper main horizontal frame members 18.

Figures 2, 3, 4:
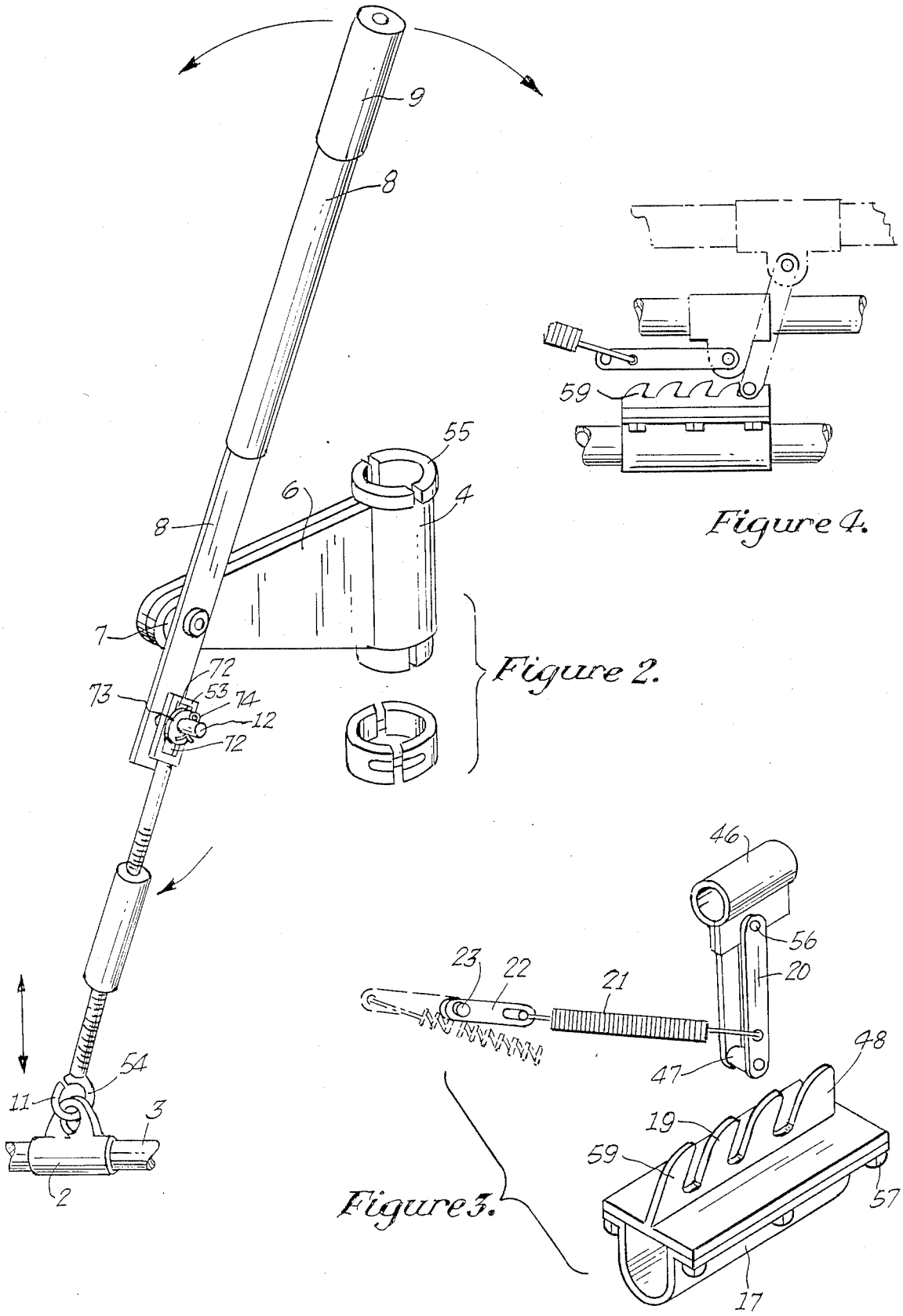
FIG. 2 is a perspective drawing of the components of the width reduction linkage.
FIG. 3 is a perspective drawing of the width adjustment retention mechanism.
FIG. 4 is a fragmentary view of the width adjustment retention mechanism illustrating its operation .

Referring now to the width reduction linkage in detail, attention is drawn to FIG. 2 wherein the components of a preferred embodiment are most clearly shown. A lifting bracket 4, is mounted for axial rotation about the main vertical frame member 5. The lifting bracket 4, is secured against vertical movement by restraint means, such as for example circumferential screw clamp 45 and may be provided with sleeve bearings or other suitable bearing means 55. Pivot support bracket 6 is operatively integral with the lifting bracket 4 and has pivot means 7 for pivotally supporting a jack lever or lifting lever 8. Preferably the pivot support bracket 5 is constructed in a manner to distribute the load at the pivot means 7, across the entirety of the lifting bracket 4. The lifting lever 8 has two ends, an operator's end at which is disposed a hand grip portion 9, and a power application end having pivot means 12. Although the lifting lever is shown as a rigid one piece member, it could be made variable in length by any of various well known constructions including, for example, telescoping tubular members. An adjustable length linkage 10 is pivotally connected to the jack lever 8 through pivot means 12. In the preferred embodiment the adjustable length linkage 10, is generally composed of two solid bars connected by a turn buckle element. Alternatively the length of linkage 10 can be made adjustable by use of a slider coupling, a cable, a chain or numerous other known equivalent mechanical connections. Adjustable length linkage 10 has a power reception end 53 which is pivotally mounted to the lifting lever 8 and a load transferrance end 54. End 53 of linkage 10 preferably provides a lost motion connection as indicated to allow handle 8 to be pivoted between the occupant operated and attendant operated positions and also to permit the chair to be completely collapsed for storing. As seen in FIG. 1, this lost motion connection may comprise an elongated slot 72 in which pivot 12 of lever 8 travels. Pivot 12 is retained in slot 72 by a washer 73 and cotter pin 74. Other known means of providing lost motion or retaining pivot means 12 may be utilized. The load transferrance end 54 of the adjustable length linkage is operatively connected to seat bracket 2 by suitable means such as the loops 11 which will allow the parts to move relative to each other as hereinafter indicated. In an embodiment which would use a cable, or chain member in place of the adjustable length linkage 10, the connecting means could be a simple pivot, since the cable, or chain member would allow rotation of the width reduction linkage. The seat bracket 2 is axially mounted along the horizontal seat support member 3.

Referring again to FIG. 1, pawl adjustment means are operatively mounted between the horizontal seat support member 3 and the upper main horizontal frame member 18. A preferred embodiment of the adjustment means is best seen in FIGS. 3 and 4 and comprises means for retaining the wheelchair in a preselected reduced width condition.

The pawl engagement means consists of pawl linkage support bracket 46, pawl linkage 20, pawl 47, elastic means or spring 21, control link 22, and engagement link lock 23. Pawl linkage support bracket 46, is axially attached to the horizontal seat support member 3. The pawl linkage support bracket is provided with a pivot 56 which pivotally supports the pawl linkage 20 for pivotal motion about an axis perpendicular with the axis of the horizontal seat support member 3. Pawl 47, is secured between the links of the pawl linkage 20 at the end opposite the pivotal connection of the pawl linkage 20 to pivot 56. Elastic means 21, are connected between pawl linkage 20 and a control link 22. Elastic means 21 is illustrated as a tension spring but may be an elastomeric device or other suitable elastic member. As shown in FIG. 3, the control link 22 is in its free or slack position in which substantially no tension is applied to the pawl linkage 20. In this condition, pawl linkage 20 will hang by gravity. The control link 22 may be maintained in a set position by frictional engagement with the horizontal seat support member 3, by means of a link lock 23, which may be a thumb screw as shown, secured to the horizontal seat support member 3.

As shown in FIG. 3, the adjustment bracket consists of an adjustment bracket clamp 17 and an adjustment stop plate 48. The adjustment bracket clamp 17, is secured axially along the upper main horizontal frame member 18 by a series of bolts 57 or other suitable fastening means threaded into the adjacent stop plate thus securing the entire assembly to the upper main horizontal frame member 18. The adjustment stop plate 48 has a series of adjustment teeth or stops 19, operatively integral with its upper surface.

Referring once again to FIG. 1 a reinforcing bar 13, is mounted between the handle portion 16 of the main vertical frame member 5 and the lower main horizontal frame member 15. Adjustment means 14, may be provided along the reinforcing bar to accommodate various dimensional situations.

With an occupant positioned in the seat of the wheelchair and the chair in its fully open position, seat support members 3 will be supported by cross members 44 and tubular frame members 50 and 51 with seat support member 3 slightly above upper main horizontal frame members 18. The occupant's weight is transmitted to lower horizontal frame members 15 and 52. Ultimately the entire load is transferred through the frame members to front wheel assemblies 43, and rear wheels 42. When a downward force is applied to the upper ends of the cross members 44 or the side frames are moved apart the cross members rotate about their common pivot 58 until full width of the chair is reached. When an upward force is applied to the upper ends of the cross members as by lifting the seat, or an inwardly directed force is applied to the seat support members 3 or the side frames, the side frames will move toward each other, narrowing the width of the chair until the fully collapsed position of the chair is reached. Referring to FIG. 1, corresponding ends of opposite cross members are connected respectively to horizontal seat support members 3, and lower main horizontal frame members 15. At this point it should be noted that lower main horizontal frame members 15 and upper main horizontal frame members 18 are rigidly connected to each other through main vertical frame members 5, and front vertical frame members 49. When an occupant seated in the chair wishes to operate the device to reduce the width of the wheelchair from its full width position, lifting lever 8 is oriented so that it is in the occupant activated position shown in solid lines in FIG. 1. He will then push downward on the hand grip 9 of the lifting lever causing it to rotate about pivot means 7. This will cause the power application end of the lifting lever 8 to move upward, raising the adjustable length linkage 10 upward with it. As previously described, the load transferrence end of the adjustable length linkage 10, is operatively connected through the loops 11, to the seat bracket 2, therefore when the power application end of the lifting lever 8 rises, the seat bracket 2 and seat support member 3 will be raised in a substantially linear motion. As explained above, this will cause cross members 44 to pivot about their common axis in a direction to reduce the distance between the two side frames of the chair, thereby reducing the width of the chair.

Conceptually stated, when the activation lever 8 is pushed downward it produces a larger upward force at the adjustable length linkage 10 in proportion to the ratio of the length from the handle end of the lever to the pivot 7 to the length of the lever between the pivot 7 and the pivot 12. This raises the horizontal seat support member 3 upward thereby reducing the width of the chair. When the force is applied by the occupant of the chair, pushing down on the lever tends to reduce his effective weight on the seat, making it easier to raise the seat to reduce the width of the wheelchair. When the lifting lever is not in use, support bracket 6 can be rotated away from the occupant of the chair about bracket 4 to allow greater freedom of movement by the occupant. When it is desired to move the jack lever into position for operation by an attendant, it is rotated upward as viewed in FIG. 1. The lost motion connection between lever 8 and adjustable length linkage 10 will allow the lever to pass through the over-center position and assume the position shown in dot-dash lines in FIG. 1 where it can be operated by an attendant. Because of the leverage produced by the use of lifting lever 8, and the previously mentioned ability for the device to be operated by either a user or an attendant, the device is able to accommodate virtually any wheelchair user irrespective of personal strength.

Figure 9:
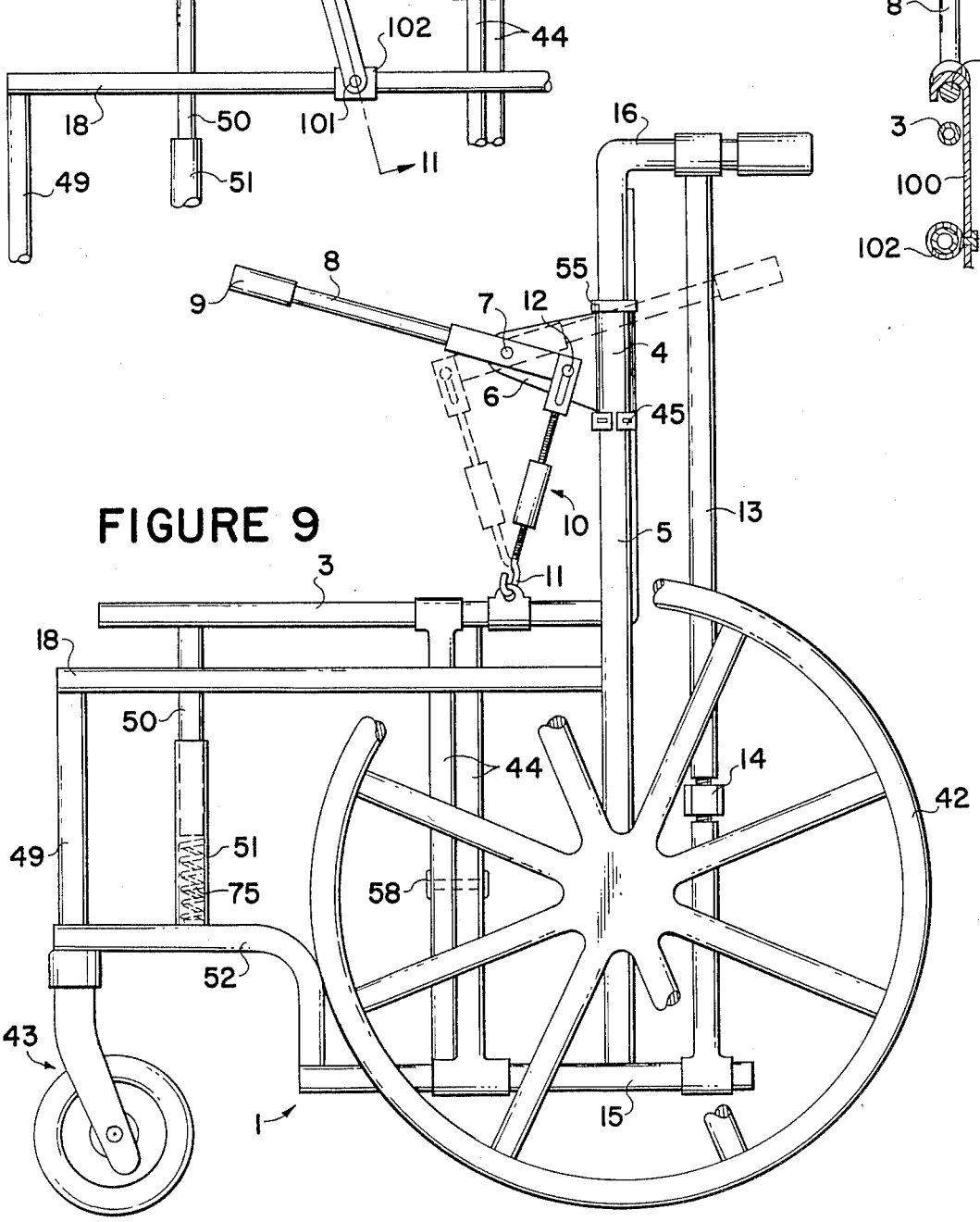
FIG. 9 is a side view similar to FIG. 1 but showing a simplified version of the invention which omits a width adjustment retention mechanism.

Adjustment means are provided so that when the chair is in a reduced width position, the chair may be conveniently maintained at the reduced width without further application of force for as long as desired. When the chair is moved to a reduced width position the distance between the horizontal seat support member 3, and the upper main horizontal frame member 18, increases. When the control link 22 is released by loosening thumb screw 23, tension of spring 21 will be released, allowing the pawl linkage 20 to pivot freely about pivot 56. When the seat support member 3 is in its lowermost position, illustrated by solid lines in FIG. 4, pawl linkage 20 will be in a substantially horizontal position with pawl 47 outside of adjustment tooth 59. It can be seen that as seat support member 3 is raised to narrow the width of the chair, pawl 47 will move to the right in FIG. 4 seeking the position between adjustment stops 19 which best suits the altered vertical dimension between horizontal seat support member 3 and upper main horizontal frame member 18. The horizontal seat support member 3 and the upper main horizontal frame member 18 are thus rigidly separated by pawl linkage 20, maintaining the chair in the reduced width position. The pawl 47 may be removed from engagement with the adjustment stops 19 by rotating the pivotal engagement link 22 to the position shown in FIG. 1 in which spring 21 is in tension and tightening thumb screw 23. A slight raising of the chair seat by the use of the jack lever will allow pawl 47 to be pulled out of engagement with the stops 19. Releasing the jack lever will allow the chair to return to a full width position or a selected intermediate width. FIG. 9 shows a radically simplified form of the invention in which the width adjustment means illustrated in FIG. 1 are completely omitted. It greatly simplifies the construction of the attachment, reduces the structure necessary to attach it to a wheelchair and also greatly reduces its cost, making it available to more people.

In the form of the invention shown in FIG. 9, pushing downward on lifting lever 8 raises horizontal seat support member 3, reducing the width of the chair, as previously described, by the pivoting of cross members 44 about pivot means 58. When the lever is released, the weight of a person in the chair forces horizontal seat support member 3 downward causing the chair to return to its normal width.

Figure 10:
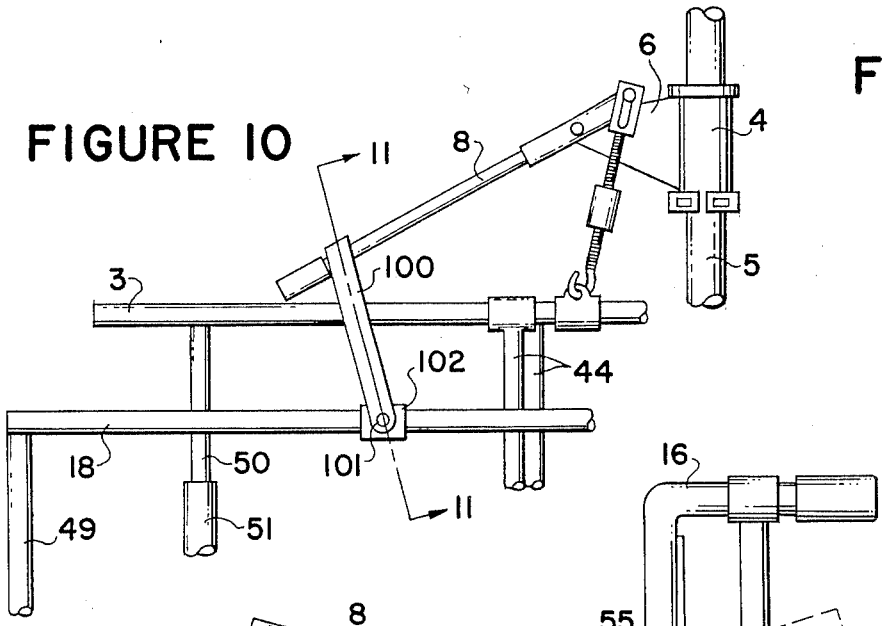
FIG. 10 is a partial view of the invention as shown in FIG. 9 but with an optional lifting lever locking link.
Figure 11:
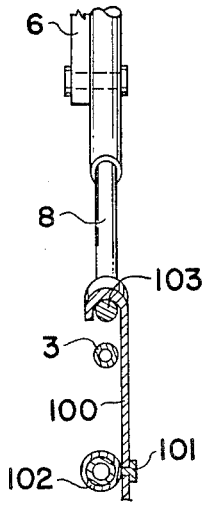
FIG. 11 is a cross-sectional view of the optional locking link mechanism taken along the line 11—11 in FIG. 10.

A less complicated width adjustment holding mechanism than that illustrated in FIG. 1 may be utilized as shown in FIGS. 10 and 11. The simplified width adjustment holding mechanism may include means for retaining the wheelchair in a preselected reduced width condition and consists of a locking link 100 pivotable on pivot 101 provided on pivot bracket 102 which is secured to upper main horizontal frame member 18. Locking link 100 has a hook 103 formed on its free end. Hook 103 is shaped to conform generally to the outer circumference of lifting lever 8. The hook 103 on link 100 is inclined in the transverse direction so that it will conform substantially to the inclined surface of jack lever 8 when link 100 engages the jack lever in the locking position.

As illustrated in FIGS. 10 and 11, the link 100 is made so that it will hold lifting lever 8 in a predetermined position of reduced width of the wheelchair. Typically, this will be at the position of greatest width reduction, that is, at the narrowest position of the wheelchair to which it can be adjusted. However, as can readily be seen, the wheelchair can be locked at a different position of width adjustment by changing the length of the locking link 100. As previously stated, this embodiment of the invention is intended to be made in the simplest, least expensive construction. However, it is obvious that locking link 100 can be made adjustabe in length so that the user of the wheelchair can select a position most suitable to his needs. Numerous simple and inexpensive ways to make the length of locking link 100 adjustable are well known in the prior art and may be utilized here.

As can best be seen by referring to FIG. 10, locking link 100 may be pivoted to a horizontal or nearly horizontal position where it will be out of locking position with respect to jack lever 8. In this position of locking link 100 if jack lever 8 is moved downward to reduce the chair width and then released, it will return to its normal or released position in which it is shown in FIG. 9. When it is desired to lock the chair in a given position of reduced width, the jack lever is moved downward until it is slightly below the position where it can be engaged by the locking link 100 and the locking link is pivoted to a generally vertical position where it will engage the jack lever 8 as shown in FIGS. 10 and 11. A more practical method of operation, however, is to leave locking link 100 in its locking position as shown in FIGS. 10 and 11 and after the jack lever 8 has been moved downward past the hook 103 to deflect the lever 8 laterally a slight amount to a position where it will be engaged by the hook 103. To release the jack lever 8, it if first moved downward and then laterally to a position where it will bypass the hook 13 and return to its released position.

A pivoted locking link similar to link 100 may be provided at the rear of the wheelchair to permit the jack lever 8 to be locked in its downward position when it is disposed for operation by an attendant. The pivot bracket for such a locking link can be secured to main vertical frame member 5 or to the reinforcing bar 13.

Because of the moment produced at the pivotal lifting bracket 4 tending to bend main vertical frame member 5 forwards, a reinforcing bar 13 is provided between the handle portion 16 of the main vertical frame member 5 and the lower main horizontal frame member 15. This reinforcing bar is provided with adjustment means 14 of any suitable configuration, many of which are available in the art. The reinforcing bar serves to counteract the bending moment which acts on main vertical frame member 5 and helps reduce fatigue in the materials used in the chair's construction. It is foreseen that the reinforcing bar structure may not be required on many of the chairs in use, and furthermore it is in no way required for operation of the invention.

The invention may be mounted on either side of the wheelchair for either left handed or right handed operation. When the device is not required for immediate use it may be conveniently pivoted to a position of nonuse as previously described, such movement being readily permitted by the rotary mounting of the lifting bracket 4, and the full movement of connecting means 11. This provides an added convenience for both user and attendant.

Figure 5:
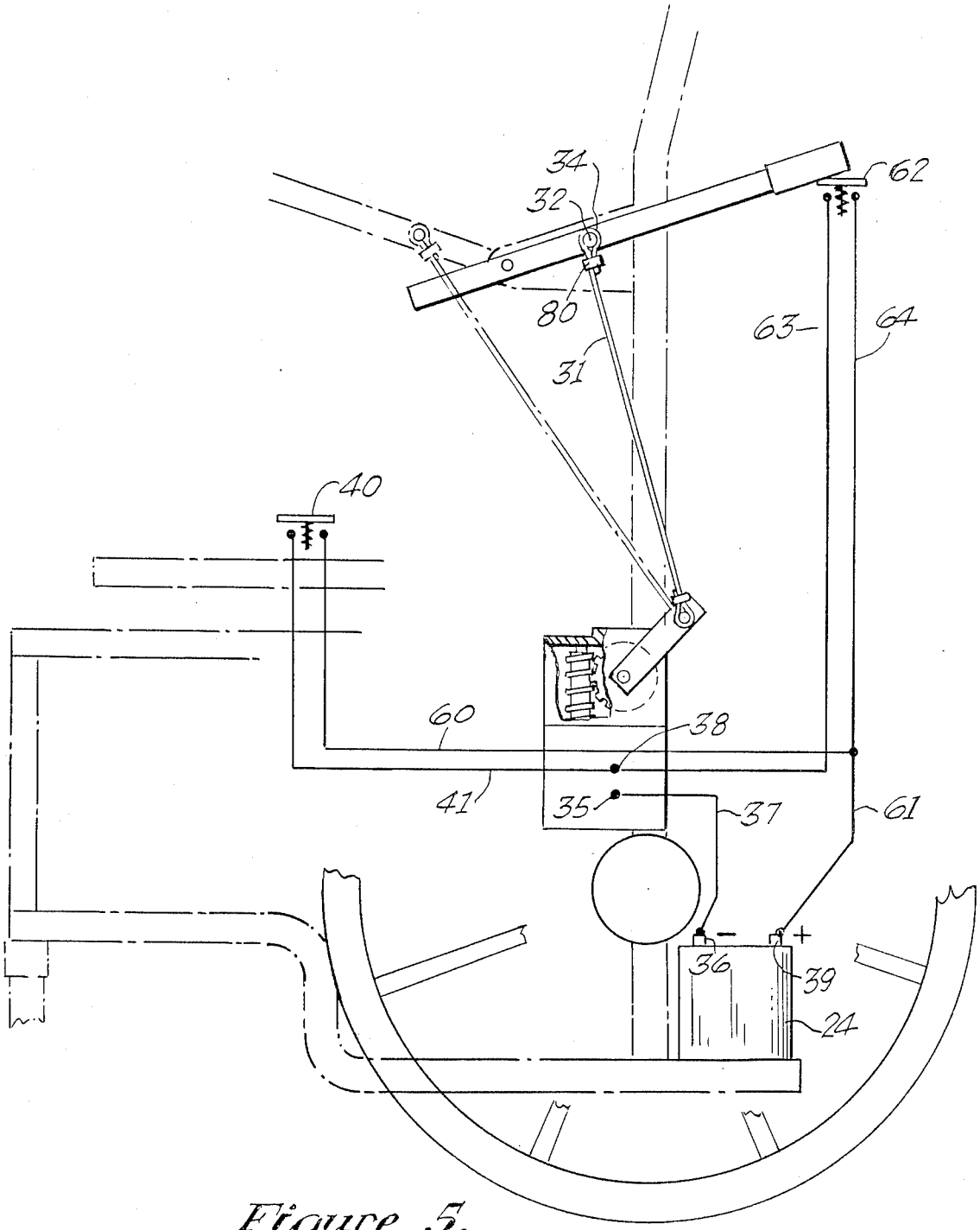
FIG. 5 is a schematic representation of one form of power operated option with portions broken away for clarity.

FIG. 5 shows a power operated modification of the invention in which optional power means are added in conjunction with the invention in the mechanical form as described above and FIG. 6 shows power operated means which can be applied to the wheelchair either in lieu of the manually operated means or in tandem therewith. FIGS. 7 and 8 disclose another form of power operated means.

Turning now to FIG. 5 there is shown a battery 24 supported by suitable means, not shown, on portions of the chair frame. A motor 25 is secured by suitable means, not shown, to main vertical frame member 5 and has a suitable gear reduction mechanism 26 including a worm gear 76 and an output gear 27. The gears are preferably enclosed in a housing 77. Gear 27 may be the output gear of mechanism 26 or may be a separate gear driven through the output gear of reduction mechanism 26. Gear 27 has rigidly secured to it or to its shaft 78 a crank lever 28 which has at its free end 29 and freely rotatable therein a pivot pin 30. Crank lever 28 may be provided with suitable bearing means, not shown, to allow free pivoting motion of pivot pin 30. A steel cable or other suitable flexible force transmitting member 31 is connected between pivot pin 30 and a pivot pin 32 rotatably secured to an intermediate point in lifting lever 8. Lifting lever 8 may be provided with suitable bearing means to provide easy rotation of pivot pin 32. Cable 31 is secured to pivot pin 30 by a loop 33 and to pivot pin 32 by a loop 34. Cable loops 33 and 34 are suitably secured by ferrules 79 and 80 respectively. The negative or ground terminal 35 of motor 25 is electrically connected to the negative or ground terminal 36 of battery 24 by conductor 37 and the positive terminal 38 of motor 25 is connected to the positive terminal 39 of battery 24, through switch 40, by conductors 41, 60 and 61. Switch 40 is of the momentary contact type and may be mounted in a position convenient for operation by the occupant of the wheelchair. If desired, a remote switch 62 may be connected in parallel with switch 40 through conductors 63 and 64 and mounted in a position convenient for operation by an attendant. A suitable guard, not shown, may be provided to prevent engagement by the crank lever or cable with the fingers or clothing of the occupant of the wheelchair. Cable 31 may be provided with a length adjusting means, not shown, of any suitable form. Cable 31 is initially adjusted to extend between pivot pin 30 and upper pivot pin 32 in a taut condition when crank lever 28 lies in its uppermost position along a line connecting the center of upper pivot pin 32, the center of pivot pin 30 and the center of rotation of gear 27. When gear 27 rotates from this initial position under the influence of motor 25, crank lever 28 will move in a direction which will pull cable 31, lifting pivot 12 and linkage 10 and causing seat 3 to be raised and the width of the wheelchair to be narrowed. This will occur for 180° of rotation of gear 27. If gear 27 rotates beyond that point the force pulling cable 31 downward will be relaxed and seat support members 3 will move downward under the weigth of the person in the chair. The length of crank lever 28 is selected so that the maximum movement of lever 8 under the influence of motor 25 is limited to the amount which will provide the maximum width adjustment desired. It can be seen that this design avoids any possibility of reducing the width of the chair to a position where in can become uncomfortable or dangerous to the occupant. When the chair is equipped with this auxiliary power operated adjustment means it is preferred that the pawl 47 be held out of engagement with the adjustment stop plate 48, but if it is not no harm will be done. With the power operated mechanism described the chair will remain in whatever position of adjustment is dictated by the position of pivot pin 30 since the worm gear in gear reduction system 26 makes it impossible to rotate gear 27 externally. On the other hand, it is possible to manually operate lifting lever 8 to further reduce the width of the chair up to the maximum degree of width reduction possible no matter what position of rotation the crank lever 28 is left in.

The mechanism shown in FIG. 6 may be used in conjunction with the manual system or may be used as a substitute therefor. This system utilizes the battery 24, motor 25 and gear reduction system 26 and gear 27 but in place of the crank lever 28, employs a pulley or cable drum 65 to which is secured one end of a cable 66 which passes over a pulley 67 and has its other end rigidly secured by suitable connection means 69 to horizontal seat support member 3 at a point located approximately at the center of the fore and aft weight distribution of the occupant of the chair. Pulley 67 is rigidly supported for rotation by suitable means such as a bracket 68 suitably affixed to main vertical frame member 5. As can be seen, when cable drum 65 is rotated in one direction cable 66 will be wound up on the drum raising horizontal seat support member 3 and causing the wheelchair to reduce in width, whereas when cable drum 65 is rotated in the opposite direction, the cable will be paid out allowing horizontal seat support member 3 to move downward and allowing the wheelchair to become wider. In this case, motor 25 is connected to the battery so that the polarity of current flowing through it can be changed, resulting in a reversal of the running direction of the motor and ultimately the direction of rotation of cable drum 65. Preferably, motor 25 is connected to battery 24 through one or more double-pole, double-throw switches 70 to control the direction of rotation of motor 25. The switches are biased to their center of "off" position. One of the switches 70 may be mounted at a point 81 for convenient access by the occupant of the chair. With this arrangement it is also possible when the occupant has left the chair to completely close the chair for storage by means of the power mechanism. To avoid the possibility of closing the chair beyond the position which is safe or comfortable for the occupant, a limit switch 71 of the normally-closed-contacts type is provided at a suitable point on main vertical frame member 5 so that it is contacted and caused to open when seat support member 3 reaches a predetermined point in its vertical motion and prevents closing of the chair beyond the desired position. In this case also, a suitable guard such as that generally illustrated at 82 is provided around the cable and pulley to prevent injury or damage to the occupant or his clothing. Alternatively, it would be possible to replace the cable drum and cable with other suitable equivalent devices such as a chain and sprocket.

It can readily be seen that if pulley 67 is mounted on lever 8 instead of on fixed bracket 68 and connection means 69 are secured to upper horizontal frame member 18 instead of to seat support 3, then when cable 66 is wound up on drum 65, lever 8 will be pulled down to lift the seat support 3, narrowing the chair. There will also be a two to one mechanical advantage due to using pulley 67 rather than pulling directly on lever 8. When motor 25 is reversed, cable 66 will be paid out, allowing seat support 3 to lower and the chair to widen.

It will also be seen that the accessory may be duplicated on each side of the chair for easier and smoother operation, and in the power operated versions the cable to each side of the chair may be wound on the same cable drum or connected to the same crank lever to insure that both sides of the seat are moved in unison.

FIG. 7 illustrates still another form of power operated form of the invention which can be used in connection with a mechanical lever or in place of it.

As shown in FIG. 7, motor 25 is mounted on frame member 15 so that shaft 78 which is secured against rotation with respect to gear 27 extends vertically toward seat support member 3. An extension shaft 82 is rigidly secured to shaft 78 in alignment therewith and has rigidly secured at its other end a nut 83 which is internally threaded to receive an externally threaded screw shaft 84 which extends to meet the bottom of seat support member 3, a bracket 85 attached to seat support member 3 is provided with a socket 86 into which the upper end 87 of screw shaft 84 is rigidly secured. Bracket 85 has at least limited freedom to pivot about seat support member 3 to keep socket 86 aligned with extension shaft 82 and screw shaft 84. It can readily be seen that as gear 27 and nut 83 rotate in one direction screw shaft 84 will be threaded outward from extension shaft 82 raising seat support member 3 and causing the chair to be reduced in width as previously described. When motor 25 and gear 27 are rotated in the other direction, screw shaft 84 will telescope farther into extension shaft 82, drawing seat support member 3 downward and allowing the wheelchair to assume a greater width.

FIG. 8 is a simplified schematic of the electrical circuit of the embodiment shown in FIG. 7. In FIG. 8, battery 24 is connected through a limit switch 71 and double-pull, double-throw switch 70 to motor 25 in the direction which will cause the chair to be narrowed. The switch 70 may be provided at a point convenient for operation by the occupant of the wheelchair and another may be provided at a point convenient for operation by an attendant standing at the rear of the chair. Switches 70 are of the type which are spring biased to their control or "off" position. Either of the switches 70 may be operated to the position where the motor will turn in a direction to cause the screw shaft 84 to be extended from the extension shaft 82 raising the seat support member 3 and reducing the width of the chair until seat support member 3 operates limit switch 71, causing it to open and preventing a further collapse of the chair. When either of switches 70 are operated to cause motor 25 to rotate in the other direction, screw shaft 84 will telescope into extension shaft 82 causing seat support member 3 to move downward and allowing the wheelchair to assume a wider width. Limit switch 71 is bypassed in the latter circuit.

It is to be understood that the invention disclosed herein is not limited to the details of construction and arrangement of parts illustrated in the accompanying drawings but is capable of being practiced or carried out in various ways. Furthermore, the terminology employed herein is for the purpose of description only and is not to be considered as a limitation.

It is obvious to those skilled in the art that although the invention has been shown and described in one or more preferred embodiments, many variations may be made in the form and structure here presented without departing from the scope of the present invention as set forth in the appended claims.

What is claimed is:

1. A width reducing attachment for a wheelchair which comprises a pair of side frame members pivotally connected to each other for movement toward and away from each other and seat support members connected to said side frame members in a manner to cause movement of said side frame members toward and away from each other when said seat support members are respectively raised and lowered vertically with respect to said side frame members; said width reducing attachment comprising means operable by the occupant of the wheelchair or by an attendant to raise said seat support members with respect to respective adjacent side frames, said means including an operating lever pivotally connected near one end to said adjacent side frame, said operating lever having a hand grip portion at its other end and being readily moveable without detachment from said adjacent side frame from a position in which its said other end lies forward of the pivotable connection and is accessible for operation by the occupant of the wheelchair to a position in which its said other end lies to the rear of the pivotable connection and is readily accessible for operation by an attendant standing behind the wheelchair.

2. A width reduction attachment for a wheelchair as set forth in claim 1 further comprising releasable means for selectively maintaining said wheelchair in various positions of width adjustment without any further application of force to said first mentioned means.

3. An attachment as described in claim 2 further comprising additional means effective to limit the extent to which said side frame members may be moved toward each other by operation of said attachment.

4. An attachment as described in claim 2 wherein said releasable means comprise pawl and tooth means.

5. An attachment as described in claim 2 wherein said releasable means comprise a worm gear.

6. An attachment as set forth in claim 1 wherein said operating lever is connected to said at least one of said seat support members by an adjustable length linkage.

7. An attachment as set forth in claim 1 further comprising power operated means for applying force to said operating lever effective to cause said operating lever to raise said at least one of said seat support members whereby the width of the wheelchair may be reduced by applying force to said operating lever manually or by power or by simultaneously applying force to said operating lever manually and by power.

8. An attachment as set forth in claim 7 wherein said power operated means include an electric motor.

9. An attachment as described in claim 7 further characterized by said power operated means being constructed and arranged so that they can be operated continuously without producing a width reduction beyond a predetermined maximum.

10. An attachment as set forth in claim 8 wherein said power operated means include limiting means effective to limit the minimum width of chair attainable even by continuous operation of said attachment to a width greater than the minimum width of chair which is safe and comfortable for its occupant.

11. An attachment as set forth in claim 10 wherein said limiting means comprise a crank lever.

12. A width reducing attachment for a wheelchair which comprises a pair of side frame members pivotally connected to each other for movement toward and away from each other and seat support members connected to said side frame members in a manner to cause movement of said side frame members toward and away from each other when said seat support members are respectively raised and lowered vertically with respect to said side frame members; said width reducing attachment comprising means operable by the occupant of the wheelchair to raise said seat support members with respect to respective adjacent side frames, said means including operating lever pivotally connected near one end to said adjacent side frame, an electric motor, a crank lever rotated by said electric motor, a cable connected at one end to said crank lever and at its other end to said operating lever whereby continued rotation of said crank lever by the motor will alternatively pull the cable downward causing the operating lever to move in a direction which will raise the seat support members, narrowing the wheelchair, and then relax the cable allowing the operating lever to move in a direction which will permit the seat support members to move downward under the weight of an occupant of the wheelchair, widening the wheelchair.

13. An attachment as set forth in claim 12 wherein said crank lever and cable are constructed and arranged so that the minimum chair width produced by rotation of said crank lever is not less than the minimum width which is safe and comfortable for its occupant.

14. An attachment as set forth in claim 1 further including means for retaining said wheelchair in a preselected reduced width condition.

15. An attachment as set forth in claim 14 wherein said means for retaining includes a pivoted locking link.

16. An attachment as set forth in claim 15 wherein said locking link is provided with a hook and is selectively pivotable into and out of a position in which said hook will engage the operating lever to hold it in a preselected position.

17. An attachment as described in claim 1 further comprising additional means effective to limit the extent to which said side frame members may be moved toward each other by operation of said attachment.

* * * * *